United States Patent [19]

Szer

[11] 3,934,135

[45] Jan. 20, 1976

[54] FLUORESCENT LAMP FIXTURE

[76] Inventor: Leon Szer, 35 Bealiba Road, South Caulfield, Victoria, 3162, Australia

[22] Filed: July 5, 1973

[21] Appl. No.: 376,359

[30] Foreign Application Priority Data

Feb. 1, 1973 Australia ..... 51683/73

[52] U.S. Cl... 240/78 LD; 240/51.11 R; 240/106 R; 240/147

[51] Int. Cl.[2] ..... F21S 1/02; F21V 3/02

[58] Field of Search ..... 240/146, 147, 78 LD:78 R, 240/51.11 R, 106 R

[56] References Cited

UNITED STATES PATENTS

| | | | |
|---|---|---|---|
| 2,269,182 | 1/1942 | Claspy et al. | 240/51.11 R |
| 2,319,732 | 5/1943 | Guth | 240/51.11 R |
| 2,616,027 | 10/1952 | Wilman et al. | 240/51.11 R |
| 2,643,328 | 6/1953 | Elmendorf | 240/57.11 R |
| 2,694,775 | 11/1954 | Florence | 240/147 |
| 2,913,575 | 11/1959 | Lipscomb | 240/106 X |
| 3,101,178 | 8/1963 | Young | 240/51.11 R |
| 3,117,729 | 1/1964 | Silvers et al. | 240/147 X |
| 3,120,929 | 2/1964 | Henning | 240/51.11 R |
| 3,159,352 | 12/1964 | Wakefield et al. | 240/51.11 R |

*Primary Examiner*—Joseph F. Peters, Jr.
*Attorney, Agent, or Firm*—Gerald S. Geren

[57] ABSTRACT

A fluorescent lamp fitting which includes a sheet metal base having a pair of inwardly-directed flanges and a flexible plastic diffuser having outwardly-directed flanges which cooperate with said inwardly-directed flanges to hold said diffuser in relation to said base.

1 Claim, 8 Drawing Figures

FIG-1
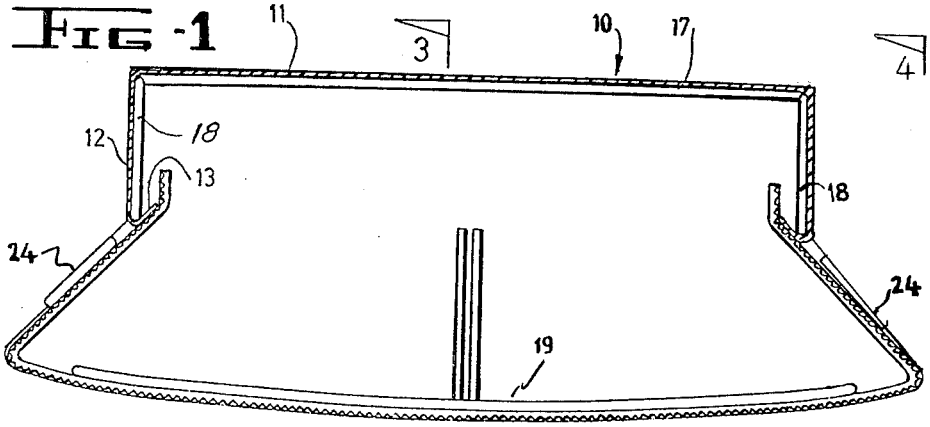
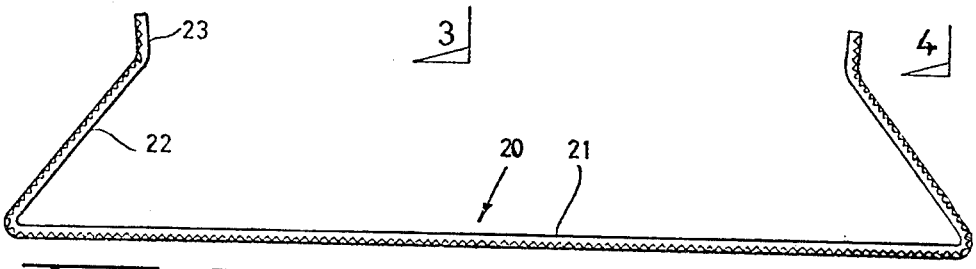
FIG-2
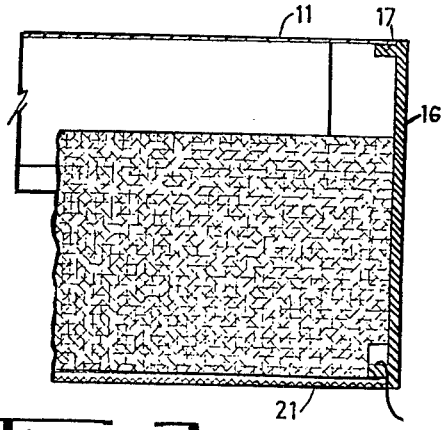
FIG-3
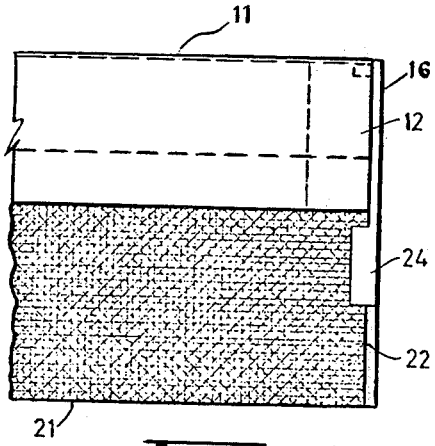
FIG-4
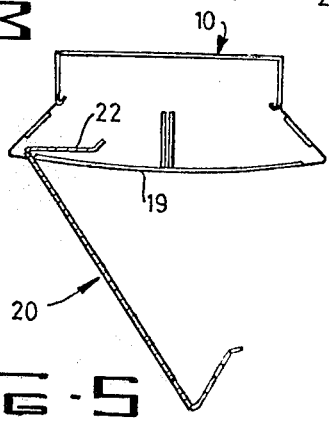
FIG-5

FLUORESCENT LAMP FIXTURE

BACKGROUND OF THE INVENTION

This invention relates to fluorescent lamp fittings and particularly to ceiling-mounted units.

There are several criteria which are often required to be met by fluorescent lamp units which are to be ceiling-mounted. One of these is a good light distribution, both as far as spreading light evenly over the area to be illuminated and also by making the best use of the light from the tube or tubes of the unit. It is also desirable to provide a unit which is simple for the manufacturer to assemble. A third is to make a unit which can easily be serviced when in position, bearing in mind that such units are often located at 10 feet to 12 feet above floor level.

There have previously been proposed various fluorescent light units which satisfy one or more of the foregoing criteria, but generally they do not satisfy each of these criteria.

It is an object of the present invention to provide a fluorescent lamp fitting which is economical to manufacture, while being sturdy, which can be serviced relatively easily when located and which, at the same time, provides a good light output.

SUMMARY OF THE INVENTION

By virtue of this invention there is provided a fluorescent lamp fitting which includes a base plate and a diffuser which can be clipped to the base plate, the base plate having inwardly-directed flanges and the diffuser having outwardly-directed flanges which are adapted to inter-engage whereby the diffuser is held in its required position.

Preferably there are also provided end caps which are frictionally fitted within the ends of the base plate or connecting sleeves, whereby two lamps can be interconnected, with little or no spacing therebetween.

In a preferred form of the invention the end caps are provided with flanges along their lower surfaces, which flanges act to cause the diffuser to adopt a required shape and which may also act, together with part of the diffuser, to enable the diffuser to be pivoted from either side, so that, for example, lamp replacement or cleaning of the diffuser can be achieved without the necessity of removing the diffuser completely from the lamp.

BRIEF DESCRIPTION OF THE DRAWINGS

In order that the invention may be more readily understood and put into practice, reference will be made to the following drawings in which:

FIG. 1 is a transverse section through a lamp made in accordance with the invention;

FIG. 2 is a transverse section of the diffuser of the lamp of FIG. 1 in its rest condition;

FIG. 3 is a sectional view taken substantially along line 3—3 of FIG. 1 looking in the direction of the arrows;

FIG. 4 is a partial elevation of the fitting looking along line 4—4 of FIG. 1;

FIG. 5 is a sectional view of the lamp showing the diffuser in its hinged downwardly condition;

DESCRIPTION OF THE PREFERRED EMBODIMENT

Figure 6:
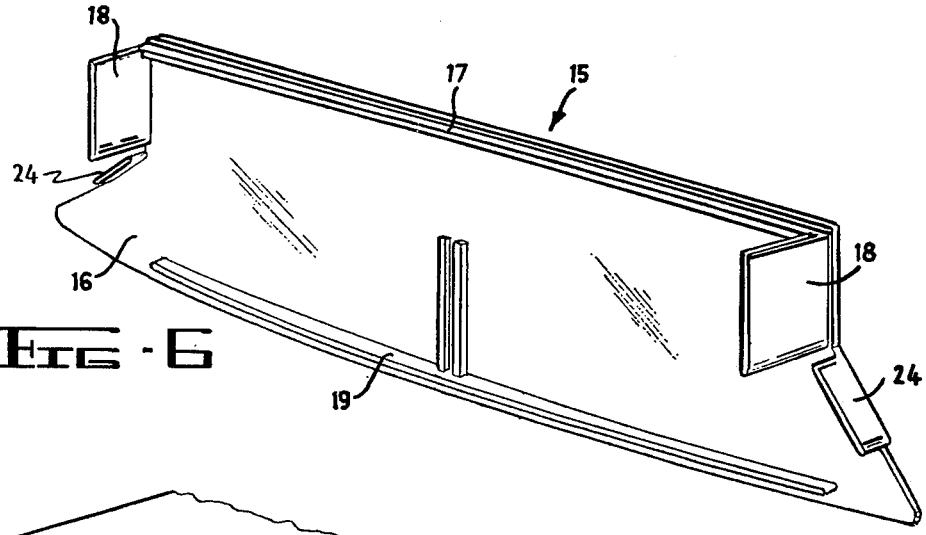
FIG. 6 is a perspective view of one of the end caps of the lamp.
Figure 7:
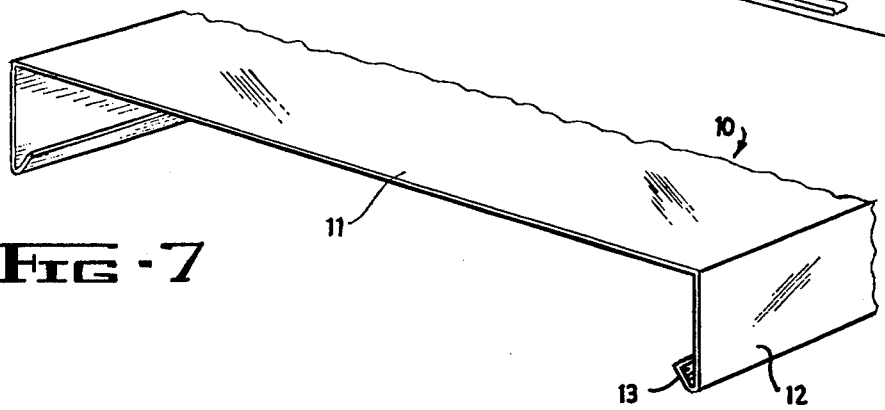
FIG. 7 is a partial perspective of the base plate.
Figure 8:
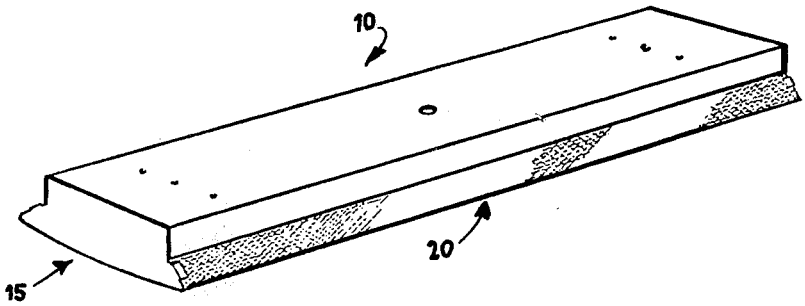
FIG. 8 is a perspective from above of the completed lamp.

Referring to FIGS. 1 and 7, the base plate 10, which may be made of sheet metal, has a web 11 from which there are two downwardly-extending flanges 12, at the outer end of each of which there is an inwardly-directed flange 13. This base plate may be made from a single sheet of metal and can be continuously rolled and cut to length, thus simplifying manufacture.

When a single fitting is to be used, there is fitted to each end of the base plate 10 an end cap 15. This end cap may be of a synthetic plastic material and has an end member 16, an upper flange 17 and two side flanges 18, the flanges 17 and 18 being adapted to frictionally fit within the base plate 10, as can be seen in FIG. 1. The end cap also has a lower flange 19 and two lower side flanges 24 which are adapted to retain and form the diffuser as will be hereinafter described.

The diffuser 20 has a main surface 21, a pair of inwardly-directed flanges 22 and a pair of outwardly-directed flanges 23. The diffuser may be an acrylic panel approximately 0.125 inch thick and may be formed on its outer surface as a prismatic panel, each prism redirecting light incident thereon at under 45°. The diffuser is slightly flexible to enable fitting, as will be described hereinafter.

When a lamp fitting is to be assembled, a base plate of the correct length is made or cut from a longer length, a diffuser of the same length is formed and two end caps are required. The fitting, of course, also needs the conventional components, connector brackets to receive the fluorescent tube or tubes, ballast(s) and starter(s). Some or all of these components may be mounted on a removable gear tray which is not illustrated.

In order to assemble the lamp it is only necessary to frictionally engage the end caps within the base plate, to locate one side of the reflector 20 with the outwardly-directed flange or extension 23 extending beyond the inwardly-directed flange or extension 13 of the base plate and with the side flange 24 lying on the outside of the reflector, and then slightly deform the diffuser by causing it to curve around the flange 19, at which time the other side of the diffuser can be located by bending inwardly-directed flange 22, so that flange 23 can pass within the flange 13 again with the flange 24 being on the outside of the diffuser. Once this position is achieved, the diffuser is fully located, its main surface adopts a curve, the shape of which is controlled by the flange 19 and the unit gives a neat and pleasing appearance. It has been found that using the unit of the invention good spread of light up to approximately 60° is obtained, there is little light output between 70° and $\pi L$ and there is a certain amount of light directed to the ceiling, which is desirable.

If it is required to change a tube or clean the diffuser, it is possible to unclip one side of the diffuser and permit the diffuser to rotate until the flange 22 assumes a position where it lies along flange 19, that is a position more or less shown in FIG. 5. As this can be done from either side, it means that in a multitube fitting, either tube can be replaced simply, and it also means that access can be obtained from either side.

In the illustrated embodiment we have shown the use of a particular form of end cap. If fittings of this general type are to be butted, it is possible to physically butt them without using end caps or if required, a doublesided end cap can be provided so that the fittings terminate closely adjacent one another but, at the same time, the span of any diffuser is not so great as that the required orientation is not maintained throughout its length.

It is to be understood that many modifications can be made in the present fitting within the scope of the appended claims.

What is claimed and desired to be secured by Letters Patent of the United States is:

1. A fluorescent light fitting adapted to be mounted on a surface for projecting light therefrom which includes: a base plate adapted for securement to said surface, said plate having inwardly-directed flanges; a removable diffuser for mounting to said base plate and for projecting said light in a predetermined manner, said diffuser having outwardly-directed flanges which are adapted to inter-engage said inwardly-directed flanges of said base plate so as to hold said diffuser in position with respect to said base plate; and end caps for mounting to the ends of said base plate, each of which have extensions complementary to said base plate for frictional inter-engagement with said base plate and where the end caps extend below the base plate and each has an inwardly-directed lower flange, which lower flange defines a required shape for the diffuser, the diffuser being flexible, and when located with its ends beneath the said lower flanges, assumes the required shape; wherein said diffuser has a main surface which lies beneath the lower flanges, an intermediate inwardly-directed flange along each edge of the main surface, and the outwardly-directed flange extends from the intermediate flanges; and wherein the lower flange of the end caps are so formed relative to the intermediate flanges of the diffuser, that the diffuser can hinge at either end of the lower flanges.

* * * * *